US009750317B2

(12) United States Patent
Ng

(10) Patent No.: US 9,750,317 B2
(45) Date of Patent: Sep. 5, 2017

(54) HAND HELD LINK MAKING DEVICE AND KIT

(71) Applicant: Choon's Design LLC, Wixom, MI (US)

(72) Inventor: Cheong Choon Ng, Novi, MI (US)

(73) Assignee: Choon's Design LLC, Wixom, MI (US)

( * ) Notice: Subject to any disclaimer, the term of this patent is extended or adjusted under 35 U.S.C. 154(b) by 45 days.

(21) Appl. No.: 14/731,509

(22) Filed: Jun. 5, 2015

(65) Prior Publication Data

US 2015/0265007 A1 Sep. 24, 2015

Related U.S. Application Data

(63) Continuation of application No. 14/331,456, filed on Jul. 15, 2014, now Pat. No. 9,149,096, which is a continuation-in-part of application No. 13/626,057, filed on Sep. 25, 2012, now Pat. No. 8,899,631.

(60) Provisional application No. 61/846,270, filed on Jul. 15, 2013.

(51) Int. Cl.
*A44C 27/00* (2006.01)
*A44C 5/00* (2006.01)

(52) U.S. Cl.
CPC ..... *A44C 27/00* (2013.01); *A44C 5/0069* (2013.01); *A44C 27/001* (2013.01)

(58) Field of Classification Search
CPC ..... A44C 27/00; A44C 5/0069
See application file for complete search history.

(56) References Cited

U.S. PATENT DOCUMENTS

| | | | |
|---|---|---|---|
| 38,192 | A | 4/1863 | Wilcox |
| 86,119 | A | 1/1869 | Allport |
| 222,937 | A | 12/1872 | Newcomb |
| 246,648 | A | 9/1881 | Wilcox |
| 254,258 | A | 2/1882 | Barbour |
| 254,288 | A | 2/1882 | Dimmick |
| 266,958 | A | 10/1882 | Gordon |
| 289,578 | A | 12/1883 | Stewart |
| 426,087 | A | 4/1890 | Wolkow |
| 763,303 | A | 6/1904 | Mayers |
| 782,657 | A | 2/1905 | Hubert |
| 843,495 | A | 2/1907 | Sander |
| 904,747 | A | 11/1908 | Anderson |

(Continued)

FOREIGN PATENT DOCUMENTS

| | | |
|---|---|---|
| CH | 201594 | 11/1937 |
| DE | 521894 | 3/1931 |

(Continued)

OTHER PUBLICATIONS

International Search Report and Written Opinion for International Application No. PCT/US2015/026280 mailed Jul. 14, 2015.

(Continued)

*Primary Examiner* — Shaun R Hurley
(74) *Attorney, Agent, or Firm* — Carlson, Gaskey & Olds, P.C.

(57) ABSTRACT

A disclosed device for creating an item consisting of a series of links includes at least two posts spaced part from each other in a first direction with each of the posts including a first arm and a second arm and an access slot.

10 Claims, 5 Drawing Sheets

(56) References Cited

U.S. PATENT DOCUMENTS

| | | | |
|---|---|---|---|
| 968,199 | A | 8/1910 | Schwartz |
| 1,020,963 | A | 3/1912 | Cake |
| 1,073,226 | A | 9/1913 | Freeman |
| 1,176,482 | A | 3/1916 | Orme |
| D51,186 | S | 8/1917 | Pearson |
| 1,279,411 | A | 9/1918 | Neuman |
| 1,318,465 | A | 10/1919 | Seifarth |
| 1,318,604 | A | 10/1919 | Schneider |
| 1,366,212 | A | 1/1921 | Pollard |
| 1,375,119 | A | 4/1921 | Stephen |
| 1,405,744 | A | 2/1922 | Sampliner |
| 1,424,458 | A | 8/1922 | Fleisher |
| 1,500,383 | A | 7/1924 | Gourie |
| 1,599,040 | A | 9/1926 | Clisby |
| 1,647,060 | A | 10/1927 | Speidel |
| 1,694,849 | A | 12/1928 | Fujii |
| 1,705,860 | A | 3/1929 | Hagihara |
| 1,718,140 | A | 6/1929 | Hagihara |
| 1,776,561 | A | 9/1930 | La Croix |
| 1,878,861 | A | 9/1932 | Krasnow |
| 1,994,659 | A | 3/1935 | De A Mascarenhas |
| 2,000,504 | A | 5/1935 | Adrian |
| 2,072,668 | A | 3/1937 | Eltgroth |
| 2,108,424 | A | 2/1938 | Bakely |
| 2,134,066 | A | 10/1938 | Van Ness |
| 2,186,692 | A | 1/1940 | Boyer et al. |
| 2,237,733 | A | 4/1941 | Grimm et al. |
| 2,270,619 | A | 1/1942 | Bowyer |
| 2,274,572 | A | 2/1942 | Yates |
| 2,318,018 | A | 5/1943 | Semonsen |
| 2,360,416 | A | 10/1944 | Gray |
| D144,079 | S | 3/1946 | Smith |
| D146,830 | S | 5/1947 | Kimmelstiel |
| 2,433,307 | A | 12/1947 | Thomas |
| 2,450,067 | A | 9/1948 | Wolff |
| 2,457,064 | A | 12/1948 | Parisi |
| 2,540,383 | A | 2/1951 | Tillert et al. |
| 2,545,409 | A | 3/1951 | McCall |
| 2,600,091 | A | 6/1952 | Becker |
| D167,727 | S | 9/1952 | Teare |
| 2,658,364 | A | 11/1953 | Carlson |
| 2,666,249 | A | 1/1954 | Ruiz et al. |
| 2,687,630 | A | 8/1954 | Carlson |
| 2,703,482 | A | 3/1955 | Auran |
| 2,707,052 | A | 4/1955 | Brown |
| 2,726,434 | A | 12/1955 | Knoblock et al. |
| 2,879,095 | A | 3/1959 | Altenweger |
| 2,984,488 | A | 5/1961 | Kirchner |
| 3,054,214 | A | 9/1962 | Smith et al. |
| 3,069,739 | A | 12/1962 | Jorgenson et al. |
| 3,112,491 | A | 12/1963 | Cleveland |
| D204,442 | S | 4/1966 | Brawley, Jr. |
| 3,276,181 | A | 10/1966 | Gilbert |
| 3,377,674 | A | 4/1968 | Brassaw et al. |
| 3,438,098 | A | 4/1969 | Grabner |
| 3,438,223 | A | 4/1969 | Linstead |
| 3,476,423 | A | 11/1969 | Kentfield |
| 3,476,426 | A | 11/1969 | Lewin |
| 3,572,679 | A | 3/1971 | Strauff |
| 3,636,987 | A | 1/1972 | Forby |
| 3,648,484 | A | 3/1972 | Gordon |
| 3,665,971 | A | 5/1972 | Ileks |
| 3,672,679 | A | 6/1972 | Burns |
| 3,678,709 | A | 7/1972 | Nowicki et al. |
| 3,688,357 | A | 9/1972 | Nielsen et al. |
| 3,693,976 | A | 9/1972 | Flack |
| 3,728,762 | A | 4/1973 | Hogg |
| 3,748,706 | A | 7/1973 | Doyel |
| 3,758,923 | A | 9/1973 | Maude |
| 3,800,372 | A | 4/1974 | Daoust |
| 3,805,345 | A | 4/1974 | Antos |
| 3,853,021 | A | 12/1974 | Hayes |
| 3,905,133 | A | 9/1975 | Charman |
| D238,812 | S | 2/1976 | Fioretti |
| 4,018,543 | A | 4/1977 | Carson et al. |
| 4,023,245 | A | 5/1977 | Zaltzman |
| 4,032,179 | A | 6/1977 | Goss |
| 4,037,513 | A | 7/1977 | Hobson |
| D245,748 | S | 9/1977 | Ostroll |
| 4,066,271 | A | 1/1978 | Lohr |
| D248,347 | S | 7/1978 | McCollum |
| 4,114,892 | A | 9/1978 | Csoka |
| 4,131,138 | A | 12/1978 | Boisvert |
| 4,179,129 | A | 12/1979 | Loomis |
| D257,257 | S | 10/1980 | McArthur |
| 4,248,063 | A | 2/1981 | Wang |
| 4,416,040 | A | 11/1983 | Towsley |
| D279,938 | S | 8/1985 | Okada |
| 4,569,108 | A | 2/1986 | Schwab |
| 4,629,100 | A | 12/1986 | Owens |
| 4,667,965 | A | 5/1987 | Helms, Jr. |
| 4,680,021 | A | 7/1987 | Maxim |
| 4,729,229 | A | 3/1988 | Whicker |
| 4,844,473 | A | 7/1989 | Landsberg |
| D310,672 | S | 9/1990 | Harvey et al. |
| D330,668 | S | 11/1992 | Nagamatsu |
| 5,163,946 | A | 11/1992 | Li |
| 5,231,742 | A | 8/1993 | Macbain |
| 5,295,280 | A | 3/1994 | Hudson et al. |
| 5,328,374 | A | 7/1994 | Stevens |
| 5,331,725 | A | 7/1994 | Chou |
| 5,377,595 | A | 1/1995 | Liu |
| 5,426,788 | A | 6/1995 | Meltzer |
| 5,437,459 | A | 8/1995 | Kirby |
| 5,459,905 | A | 10/1995 | Voyre |
| 5,577,299 | A | 11/1996 | Thompson et al. |
| 5,639,090 | A | 6/1997 | Stevens |
| 5,687,775 | A | 11/1997 | Thompson et al. |
| D389,050 | S | 1/1998 | Li |
| 5,713,094 | A | 2/1998 | Markey et al. |
| D406,749 | S | 3/1999 | Selk |
| 5,888,392 | A | 3/1999 | Frizell |
| 5,916,283 | A | 6/1999 | Steinbach |
| 5,927,764 | A | 7/1999 | Harriman |
| D425,784 | S | 5/2000 | Beugelsdyk et al. |
| 6,065,968 | A | 5/2000 | Corliss |
| D426,425 | S | 6/2000 | Hermanski |
| 6,122,859 | A | 9/2000 | Lazar |
| 6,129,551 | A | 10/2000 | Martin |
| 6,131,778 | A | 10/2000 | Etzion |
| 6,146,144 | A | 11/2000 | Fowler et al. |
| 6,149,436 | A | 11/2000 | Dunn |
| 6,171,317 | B1 | 1/2001 | Jackson et al. |
| 6,209,930 | B1 | 4/2001 | Johnston et al. |
| 6,213,918 | B1 | 4/2001 | Rogers, Jr. |
| 6,389,652 | B1 | 5/2002 | Williams |
| 6,550,177 | B1 | 4/2003 | Epple, Jr. |
| D478,738 | S | 8/2003 | Workman |
| 6,880,364 | B1 | 4/2005 | Vidolin et al. |
| 6,902,212 | B1 | 6/2005 | Mize |
| 6,923,026 | B1 | 8/2005 | Clarke |
| 7,040,120 | B2 | 5/2006 | Hunter |
| D522,352 | S | 6/2006 | Van Straaten |
| 7,264,282 | B2 | 9/2007 | Lambertz et al. |
| D552,463 | S | 10/2007 | French et al. |
| D562,358 | S | 2/2008 | Landmesser |
| D563,997 | S | 3/2008 | Gustin |
| D570,923 | S | 6/2008 | Vazquez Gastellu |
| D578,383 | S | 10/2008 | Adams |
| 7,506,524 | B2 | 3/2009 | Gustin |
| D592,537 | S | 5/2009 | Darnell |
| 7,578,146 | B2 | 8/2009 | Gustin |
| 7,617,947 | B2 | 11/2009 | Schafer |
| D608,189 | S | 1/2010 | Jackson et al. |
| 7,666,196 | B1 | 2/2010 | Miles |
| 7,677,677 | B1 | 3/2010 | Roberts |
| 7,891,506 | B2 | 2/2011 | Kornowski |
| 7,909,609 | B2 | 3/2011 | Molin |
| D635,594 | S | 4/2011 | Novak |
| D639,683 | S | 6/2011 | Essel |
| 8,316,894 | B2 | 11/2012 | Schaub |
| 8,402,794 | B2 | 3/2013 | Sasur |
| 8,418,434 | B1 | 4/2013 | Carruth et al. |
| 8,485,565 | B2 | 7/2013 | Ng |

(56) References Cited

U.S. PATENT DOCUMENTS

| | | | | |
|---|---|---|---|---|
| 8,510,916 | B2 | 8/2013 | Kinvi | |
| D690,191 | S | 9/2013 | Takakuwa et al. | |
| D696,576 | S | 12/2013 | Ng | |
| 8,596,096 | B1 | 12/2013 | Russell et al. | |
| 8,622,441 | B1 | 1/2014 | Ng | |
| 8,684,420 | B2 | 4/2014 | Ng | |
| 8,746,753 | B2 | 6/2014 | Crorey | |
| D711,931 | S | 8/2014 | Daftari | |
| 8,899,631 | B2 * | 12/2014 | Ng | A44C 5/0069 289/17 |
| 8,931,811 | B1 | 1/2015 | Ng | |
| 8,936,283 | B2 | 1/2015 | Ng | |
| 8,955,888 | B2 | 2/2015 | Ng | |
| 8,973,955 | B2 | 3/2015 | Ng | |
| 9,149,096 | B2 * | 10/2015 | Ng | A44C 5/0069 |
| 9,234,306 | B1 | 1/2016 | Chang | |
| 2004/0079109 | A1 | 4/2004 | Crova | |
| 2007/0114340 | A1 | 5/2007 | Adams | |
| 2007/0199965 | A1 | 8/2007 | Gouldson | |
| 2008/0156043 | A1 | 7/2008 | Gustin | |
| 2008/0223083 | A1 | 9/2008 | Gustin | |
| 2009/0215013 | A1 | 8/2009 | Molin | |
| 2010/0019495 | A1 | 1/2010 | Oliveto | |
| 2011/0067558 | A1 | 3/2011 | Saindon | |
| 2011/0152946 | A1 | 6/2011 | Frigg et al. | |
| 2011/0259465 | A1 | 10/2011 | Schaub | |
| 2012/0047960 | A1 | 3/2012 | Sasur | |
| 2012/0112457 | A1 | 5/2012 | Ng | |
| 2012/0150203 | A1 | 6/2012 | Brady et al. | |
| 2013/0020802 | A1 | 1/2013 | Ng | |
| 2013/0300114 | A1 | 11/2013 | Ng | |
| 2013/0307267 | A1 | 11/2013 | Ng | |
| 2014/0373966 | A1 | 12/2014 | Nedry et al. | |
| 2015/0296937 | A1 | 10/2015 | Ng | |
| 2015/0345051 | A1 | 12/2015 | Wright | |

FOREIGN PATENT DOCUMENTS

| | | | |
|---|---|---|---|
| GB | 2147918 | | 5/1985 |
| JP | S03-001676 | Y | 2/1928 |
| JP | H09291447 | | 11/1997 |
| JP | 2003-171854 | | 6/2003 |
| JP | 2003-520083 | | 7/2003 |
| JP | 2004-520910 | | 7/2004 |
| JP | D1393632 | | 8/2010 |
| JP | D1501836 | | 7/2014 |
| JP | D1501837 | | 7/2014 |
| KR | 10-2001-0012609 | | 2/2001 |
| KR | 10-2006-0042108 | | 5/2006 |
| KR | 300503642 | | 5/2008 |
| WO | 2012/060906 | A1 | 5/2012 |
| WO | 2014/190255 | A1 | 11/2014 |

OTHER PUBLICATIONS

Helmet Strap Quick Release Clip, catalog added date Nov. 10, 2011, online, http://allbrandsofthings.com/index.php?main_page=product_info&cPath=33&products_id=457&zenid=adrmed661oj5gqu9dlhqpqgmm7.

Amazon.com—Plastic Trash Can Bag Clip Clamp, review date Feb. 19, 2014, online, http://www.amazon.com/Plastic-Garbage-Rubbish-Trash-Holder/dp/B00E6Q0DQ0/ref=sr.

International Preliminary Report on Patentability for International Application No. PCT/US2013/060890 mailed Apr. 9, 2015.

International Search Report and Written Opinion for International Application No. PCT/US2013/060890 mailed Jan. 2, 2014.

International Preliminary Report on Patentability for International Application No. PCT/US2014/046106 mailed Jan. 28, 2016.

International Search Report & Written Opinion for International Application No. PCT/US2011/041553 mailed on Feb. 23, 2012.

International Preliminary Report on Patentability for International Application No. PCT/US2011/041553 mailed on May 16, 2013.

Decision to Institute of Inter Partes Review of U.S. Pat. No. 8,485,565 dated May 20, 2014, Case IPR2014-00218, from the United States Patent and Trademark Office.

European Search Report for EP Application No. 14184498.5 dated Jan. 26, 2015.

Petition for Inter Partes Review of U.S. Pat. No. 8,485,565 and Exhibits, filed in the United States Patent and Trademark Office on Mar. 3, 2015, Case No. IPR2015-00838.

Petition for Inter Partes Review of U.S. Pat. No. 8,485,565 and Exhibits, filed in the United States Patent and Trademark Office on May 1, 2015, Case No. IPR2015-01139.

Petition for Inter Partes Review of U.S. Pat. No. 8,684,420 and Exhibits, filed in the United States Patent and Trademark Office on May 4, 2015, Case No. IPR2015-01143.

Phelps, Isela, Loom Knitting Primer: A Beginner's Guide to Knitting on a Loom with Over 30 Fun Projects, 2007, pp. 12-20, 99, and 118.

Phelps, Isela G., Loom Knitting Basics: Knitting in the Round, www.dalooms.com, 2001.

How to Make a Homemade Geoboard, http://www.feelslikehomeblog.com/2010/02/how-to-make-a-geoboard/, Feb. 21, 2010.

Bipes, Anne, Loom Knitting Getting Started on the Round Loom, www.loomknitting.com, 2005.

Petition for Inter Partes Review of U.S. Pat. No. 8,622,441 and Exhibits, filed in the United States Patent and Trademark Office on Mar. 3, 2015, Case No. IPR2015-00840.

Norris, Kathy, I Can't Believe I'm Loom Knitting!, www.leisurearts.com, 2010.

Phelps, Isela, Loom Knitting Primer: A Beginner's Guide to Knitting on a Loom with Over 30 Fun Projects, 2007.

Lijovich, Basic Instructions for Using a Double Lucet, Jan. 2002, revised Jun. 2002.

The Horde of Vigdis, Aug. 5, 2011.

European Search Report for EP Application No. 14177709.4 dated Nov. 18, 2014.

European Search Report for EP Application No. 14184490.2 dated Dec. 23, 2014.

International Search Report and Written Opinion for International Application No. PCT/US14/54492 mailed Jan. 5, 2015.

Takacas, Sarah (SarahLynnTea), How to Make Rubber Band Bracelets; Published Apr. 15, 2009 http://www.youtube.com/watch?v=e0k762PJ-D8.

Introduction video—Rainbow Loom (the next generation Twistz Bandz kit). Published Sep. 24, 2012. http://www.youtube.com/watch?v=FUwf3CheGuw.

Lesson 21:"Sweet Heart" Rainbow Loom Bracelet by Choon; Published Jan. 21, 2013 http://www.youtube.com/watch?v=7l8MbYceEC0.

Rainbow Loom from Choon's Design, LLC; Published Jul. 24, 2013 http://www.youtube.com/watch?v=vhiVxnbE0CE.

How to make a rainbow loom starburst bracelet; Published Aug, 1, 2013 http://www.youtube.com/watch?v=RI7AkI5dJzo.

How To: Make the Rainbow Loom Single Band Bracelet; Published Aug. 12, 2013 http://www.youtube.com/watch?v=Wd3UdqPmKbA.

United Kingdom Combined Search and Examination Report for Application No. GB1416090.1 dated Oct. 16, 2014.

United Kingdom Combined Search and Examination Report for Application No. GB1416091.5 dated Oct. 16, 2014.

International Search Report and Written Opinion for International Application No. PCT/US14/46106 mailed Oct. 18, 2014.

International Search Report and Written Opinion for International Application No. PCT/US14/54475 mailed Oct. 27, 2014.

European Search Report for EP Application No. 13840473.6 dated Jul. 3, 2014.

Petition for Post-Grant Review of U.S. Pat. No. 8,684,420 and Exhibits, filed in the United States Patent and Trademark Office on Aug. 5, 2014, Case No. PGR2014-00008.

Petition for Inter Partes Review of U.S. Pat. No. 8,485,565 and Exhibits, filed in the United States Patent and Trademark Office on Aug. 20, 2014, Case No. IPR2014-01353.

(56) References Cited

OTHER PUBLICATIONS

How to make a fishtail rainbow loom bracelet; http://www.youtube.com/watch?v=ukv83Cvq3jk; Jul. 13, 2013.
How to Make Rubber Band Bracelets Using Twistz Bandz—Instruction #1; http://www.youtube.com/watch?v=6nInnVEjrLU; Mar. 28, 2011.
Various rubber band crafts and bracelets using Rainbow Loom®; http://www.youtube.com/watch?v=oM6sOkZFz5o; Mar. 30, 2011.
How to make "Diamond" pattern rubber band bracelet using the Rainbow Loom® Kit; http://www.youtube.com/watch?v=dZa8dpZasKA; Jun. 8, 2011.
(Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* v. *Zenacon, LLC et al*., United State District Court for the Eastern District of Michigan, Case No. 2:13-cv-13568-PJD-RSW, Mar. 7, 2014.
Petitioner's Request for Rehearing Under 37 CFR §42.71(d) filed on Jun. 3, 2014, Case IPR2014-00218, from the United States Patent and Trademark Office.
U.S. Appl. No. 13/938,717, filed Jul. 10, 2013, entitled "Brunnian Link Making Device and Kit".
U.S. Appl. No. 14/329,099, filed Jul. 11, 2014, entitled "Brunnian Link Making Device and Kit".
U.S. Appl. No. 13/626,057, filed Sep. 25, 2012, entitled "Brunnian Link Making Device and Kit".
U.S. Appl. No. 14/270,635, filed May 6, 2014, entitled "Device for Forming Brunnian Links".
Design U.S. Appl. No. 29/468,891, filed Oct. 24, 2013, entitled "Brunnian Link Forming Loom".
U.S. Appl. No. 14/226,096, filed Mar. 26, 2014, entitled "Monster Tail Loom for Forming Brunnian Links".
Design U.S. Appl. No. 29/468,549, filed Oct. 1, 2013, entitled "Brunnian Link Forming Loom".

* cited by examiner

HAND HELD LINK MAKING DEVICE AND KIT

CROSS REFERENCE TO RELATED APPLICATION

This application is a continuation of U.S. application Ser. No. 14/331,456 filed Jul. 15, 2014, which is a continuation in part of U.S. application Ser. No. 13/626,057 filed Sep. 25, 2012, and further claims priority to U.S. Provisional Application No. 61/846,270 filed on Jul. 15, 2013.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item. Accordingly there is a need and desire for a kit that provides not only the materials for creating a unique wearable item, but also that simplifies construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example kit and device provides for creation of Brunnian and other linked articles. Moreover, the example kit provides for the successful creation of unique wearable articles using Brunnian and other link assembly techniques.

The example kit includes a template for mounting an initial band and a hook utilized for attaching additional bands to the initial bands placed on the template. The template includes pins that hold the initial band in place while additional bands are linked onto each other. The kit further includes a clip utilized to attach ends once the desired length is formed.

These and other features disclosed herein can be best understood from the following specification and drawings, the following of which is a brief description.

DETAILED DESCRIPTION

Figure 1:
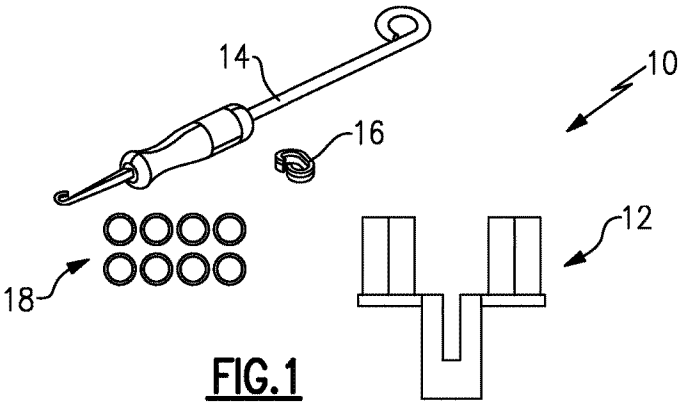
FIG. 1 perspective view of an example kit for creating a linked article.
Figure 2:
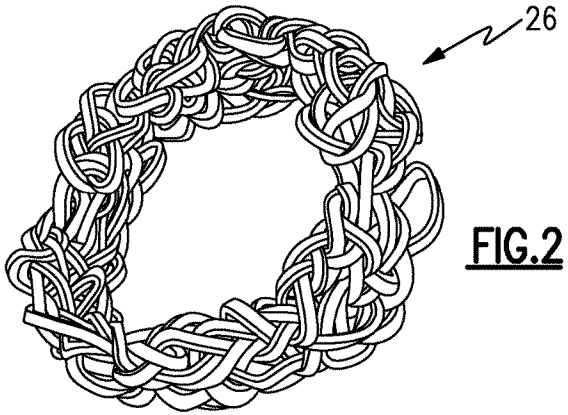
FIG. 2 is schematic view of link article.

Referring to FIGS. 1 and 2, an example kit is indicated at 10 for creating linked items such as bracelets, necklaces and other wearable or decorative article as generally indicated in FIG. 2. The example kit 10 includes a template 12, a clip 16 and a hook 14. The example kit 10 also includes a number of elastic members 18 that are used with the kit 10 to form links for the resulting wearable article. The elastic members 18 are consumed as articles are fabricated, and are replaced and replenished with additional elastic members. Moreover, the example elastic members 18 are of a size corresponding with the example template 12. Further, although a single clip 16 is illustrated, the example kit 10 will include many clips 16 to provide for the fabrication of many articles 26.

Figure 3:
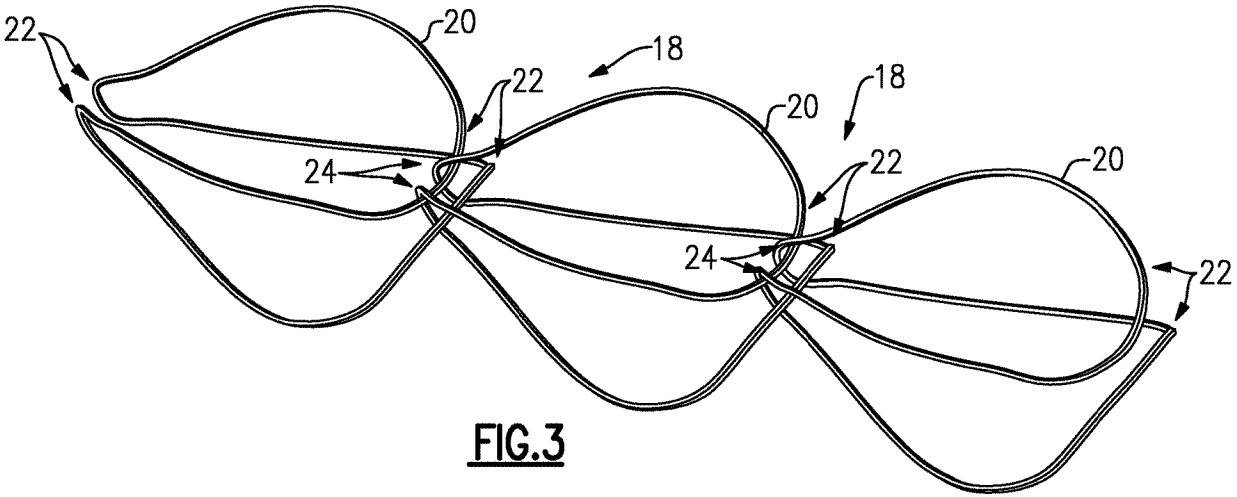
FIG. 3 is a schematic view of a series of a series of Brunnian links.

Referring to FIG. 3, a Brunnian link 20 is formed from a continuous looped structure without forming an actual knot. Several links 20 are formed in a chain to form a circular structure. Ends 22 of each elastic member 18 are secured and a durable wearable article is created. In this example three links 20 are shown forming a single chain. Each link 20 is formed by capturing the ends 22 of one loop structure with a mid portion 24 of another loop structure in series. Each link 20 depends on the previous and subsequent links 20 to maintain the desired shape and integrity. Removing one link 20 results in all of the links becoming loose from each other.

Figure 4:
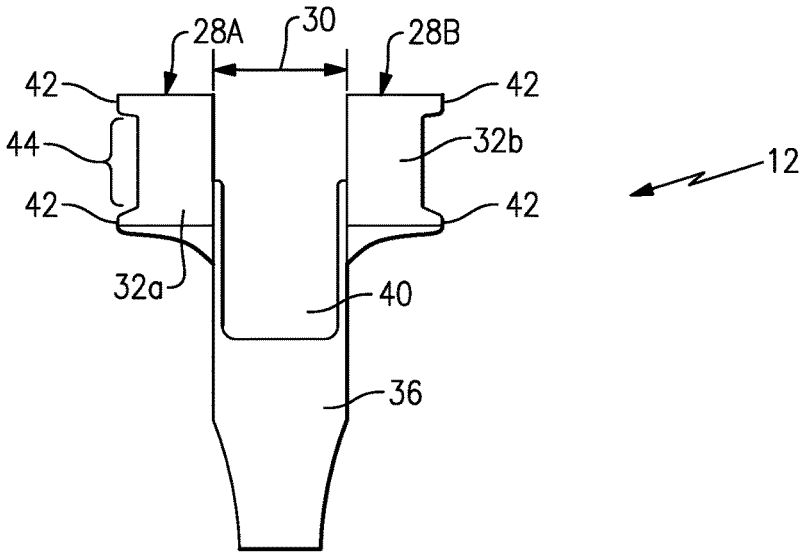
FIG. 4 is a side view of an example template.
Figure 5:
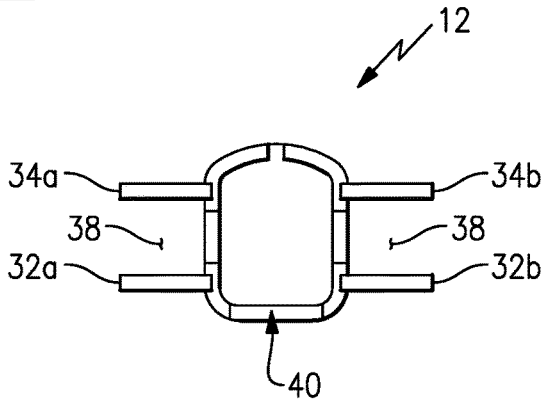
FIG. 5 is an end view of the example template.
Figure 6:
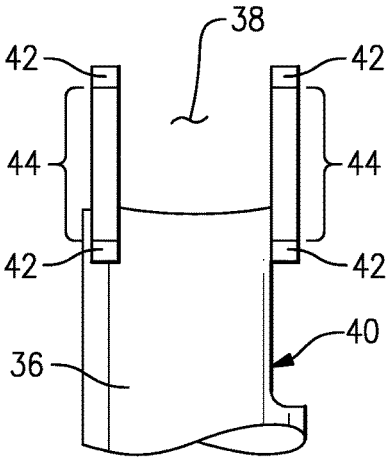
FIG. 6 is a top view of the example template.

Referring to FIGS. 4, 5 and 6, the example template 12 includes two posts 28A, 28B spaced a distance 30 apart from each other. Each of the pins 28A, 28B includes a first arm 32*a-b* and second arm 34*a-b* supported on a base 36. The arms 32*a-b*, 34*a-b* defines an access slot 38 that extends across both of the posts 28A, 28B. The base 36 includes a link opening 40 for completed links of a linked article during fabrication. Each of the first and second arms 32*a-b*, 34*a-b* include upper and lower tabs 42 that maintain a linked article within a center section 44.

Figure 7:
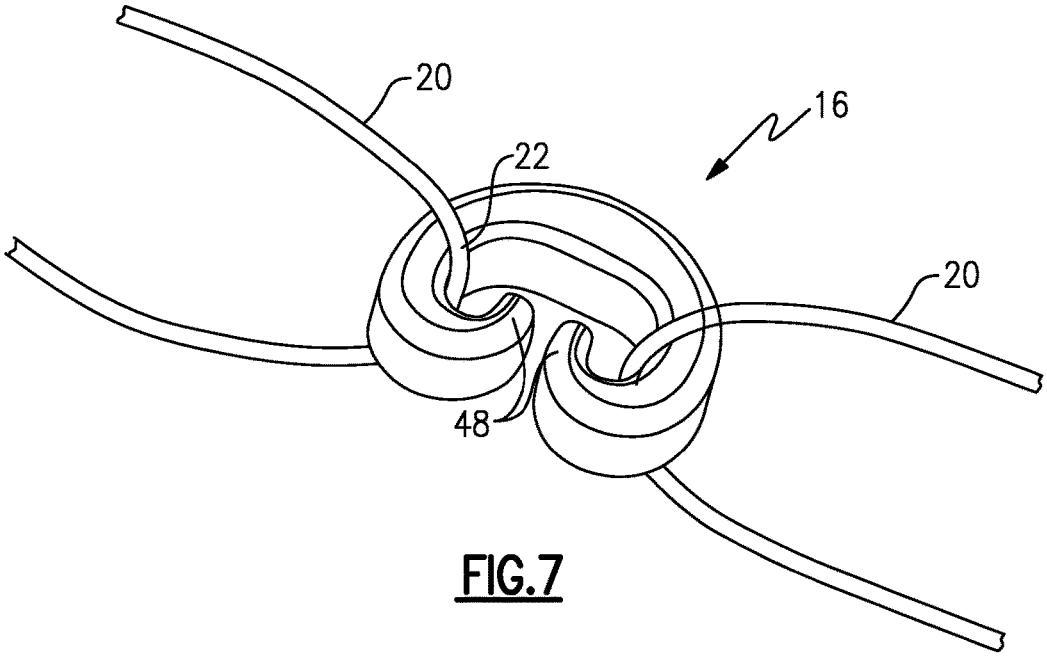
FIG. 7 is a plan view of an example clip for securing loose ends of a Brunnian linked article.
Figure 8:
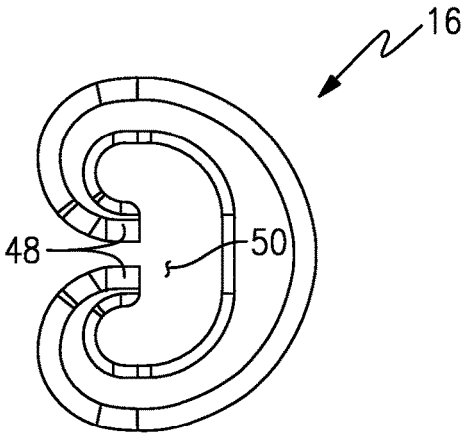
FIG. 8 is perspective view illustrating elastic bands secured with the example clip.

Referring to FIGS. 7 and 8, the example clip 16 is generally C-shaped with inwardly facing ends 48. The inwardly facing ends 48 point inwardly to an open space 50 where parts of the elastic members are kept. The inwardly facing ends 48 prevent ends 22 from sliding out from the inner area 50 off of the clip 16.

Referring to FIGS. 9A-M, the example template 12 is utilized for the formation of a linked article. As appreciated, elastic bands 18 can be difficult to manipulate and hold during the construction of a desired article. The example template 12 provides for holding of an initial number of links 20 and subsequent connection of each link in the linked article. The template 12 includes the first and second posts 28A, 28B along with the access slot 38 across both of the posts 28A-B. The specific linked configuration can be a simple Brunnian link, but may also be more complex and intricate link structures such as a fishbone type link structure. The template 12 includes the link opening 40 to facilitate the fishbone link structure where the linked article grows and extends from the template 12 through the link opening 40.

Figure 9A:
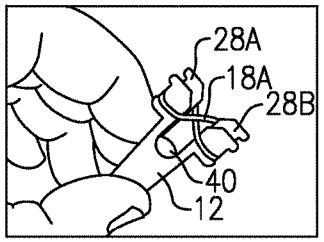
FIGS. 9A-9M are views of an example method of creating a linked article using the example template and kit.
Figure 9B:
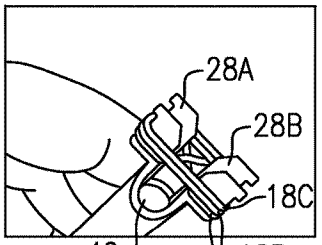

The Figures illustrate formation of a fishbone linked structure utilizing the example template 12. The initial step illustrated in FIG. 9A includes assembling a first elastic band 18A by crossing over itself to form a FIG. 8 pattern across the posts 28A-B. A second elastic band 18B and third elastic band 18C is then assembled over the first elastic band 18A without crossing over as is shown in FIG. 9B. Three elastic bands are therefore supported across the posts 28A-B with the first band 18A on the bottom below the second and third elastic bands 18B, 18C.

Figure 9C:
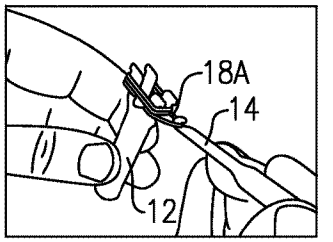
Figure 9D:
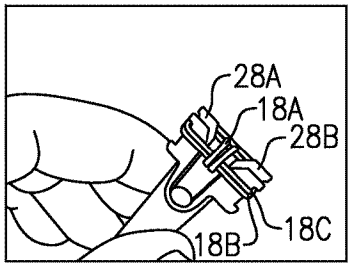

Utilizing the hook tool 14, the bottom, lower most, or first elastic band 18A is pulled off of the posts 28A-B and looped over the second and third elastic bands 18B, 18C as is shown in FIGS. 9C and 9D. The first elastic band 18A is positioned to loop around each of the second and third elastic bands 18B, 18C and is not supported directly by the posts 28A-B.

Figure 9E:
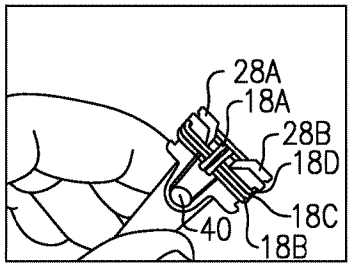

An additional elastic band 18D is then added above the second and third elastic bands 18B, 18C such that the second elastic band 18B is now the lower most elastic band as is shown in FIG. 9E. The lower most elastic band 18B is then grasped with the hook tool 14 (FIG. 9F) by extending the hook tool 14 into the access slot 38 and grasping ends of the elastic band in sequence, pulling the ends away from the corresponding post (FIG. 9G) and looping each end over onto the and around the other links supported between the first and second posts as is shown in FIG. 9H.

Figure 9F:
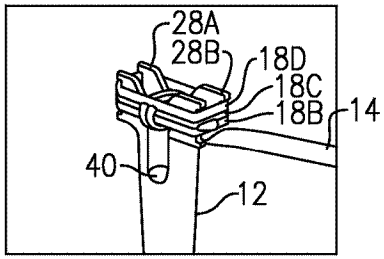
Figure 9G:
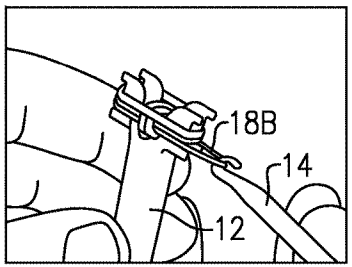
Figure 9H:
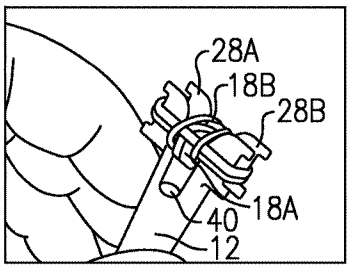
Figure 9I:
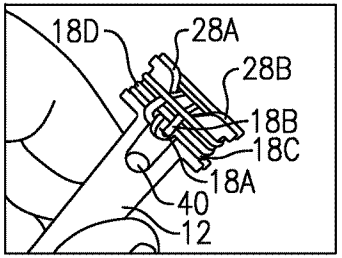
Figure 9J:
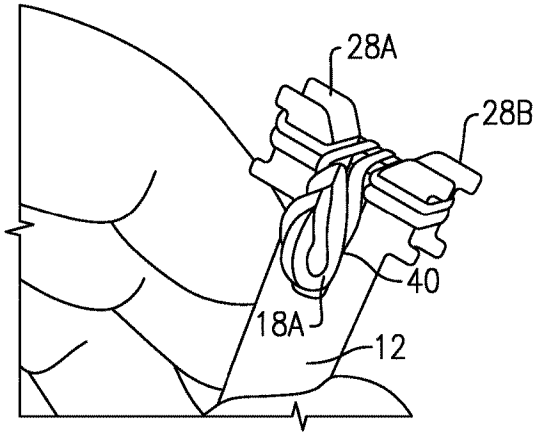
Figure 9K:
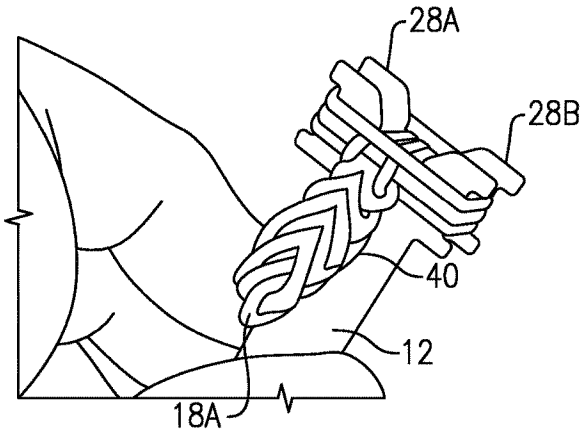
Figure 9L:
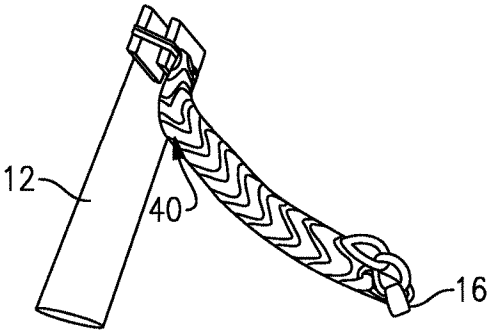

An additional link is added above the two remaining links 18C, 18D across the two posts 28A-B as is shown in FIG. 9I and the process shown in FIGS. 9F through 9H is repeated with additional links to grow the length of the linked structure as is shown in FIGS. 9J and 9K until a desire length or number of links are connected to each other as is illustrated in FIG. 9L.

Figure 9M:
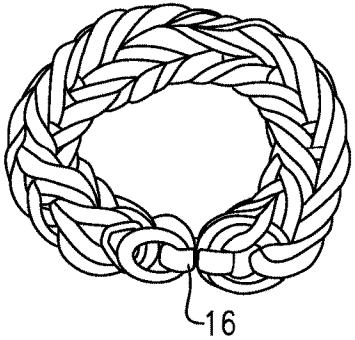

Once the desired length is achieved, as the example in FIG. 9L illustrates a clip 16 is attached to the end elastic link. The remaining links on the posts 28A-B can be removed and attached to the clip 16 to form the completed linked article as is shown in FIG. 9M. As appreciated although the ends are connected to form the example linked article. The linked article may have terminal ends that are separately terminated to provide a length of a linked article.

Accordingly, the example kit and method provide for the creation of many different combinations and configurations of linked structures and articles for the creation of bracelets, necklaces, and other wearable items. Moreover, the example kit is expandable to further create and expand the capabilities of potential linked structures and articles. Further, the example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A kit for creating an item consisting of a series of links, the kit comprising:

a plurality of elastic bands, wherein each of the plurality of elastic bands comprise a closed loop; and a template including at least two posts spaced apart from each other in a first direction, wherein each of the at least two posts includes a longitudinal channel bounded on three sides, a first tab near a top portion and a second tab near a bottom portion of the at least two posts for holding an elastic band across the at least two posts.

2. The kit as recited in claim 1, including at least one connector for securing an elastic band on one end of series of links to another elastic band on second end of the series of links.

3. The kit as recited in claim 2, including a base supporting the at least two posts, the base defining an open space between the at least two posts.

4. The kit as recited in claim 1, wherein the longitudinal channel on each of the at least two posts face in opposing directions.

5. The kit as recited in claim 4, wherein the longitudinal channel extends through the top surface of each of the at least two posts.

6. The kit as recited in claim 5, wherein the longitudinal channel opens to an outward facing side of each of the at least two posts.

7. The kit as recited in claim 1, including a hook for manipulating elastic bands held between the at least two posts.

8. A device for creating a linked article from elastic bands, the device comprising:

at least two posts spaced apart from each other and supported on a base, wherein each of the at least two posts include a longitudinal channel, a first tab spaced apart from a second tab for holding an elastic band therebetween, and a space defined within the base between the at least two posts and each of the at least two posts comprise a first arm and a second arm.

9. The device as recited in claim 8, wherein the base comprises a cylinder and the space is an opening through the cylinder.

10. The device as recited in claim 9, including a link opening on at one side of the cylinder to provide a space for linked elastic bands during fabrication of the linked article.

* * * * *